US006247776B1

(12) United States Patent
Usui et al.

(10) Patent No.: US 6,247,776 B1
(45) Date of Patent: Jun. 19, 2001

(54) INK JET RECORDING APPARATUS FOR ADJUSTING THE WEIGHT OF INK DROPLETS

(75) Inventors: Toshiki Usui; Takahiro Katakura, both of Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/202,416

(22) PCT Filed: Apr. 17, 1998

(86) PCT No.: PCT/JP98/01762

§ 371 Date: Dec. 14, 1998

§ 102(e) Date: Dec. 14, 1998

(87) PCT Pub. No.: WO98/47711

PCT Pub. Date: Oct. 29, 1998

(30) Foreign Application Priority Data

Apr. 18, 1997 (JP) ..... 9-116140

(51) Int. Cl.[7] ..... B41J 2/205
(52) U.S. Cl. ..... 347/11; 347/15
(58) Field of Search ..... 347/9–11, 14, 347/17, 15

(56) References Cited

U.S. PATENT DOCUMENTS 4,491,851 1/1985 Mizuno et al. ..... 346/1.1
4,897,665 1/1990 Aoki ..... 347/10
6,024,438 * 2/2000 Koike et al. ..... 347/43

FOREIGN PATENT DOCUMENTS 1-275148 11/1989 (JP) ..... B41J/3/04
4-73154 3/1992 (JP) ..... B41J/2/045
4-339660 11/1992 (JP) ..... B41J/2/045
8-187852 7/1996 (JP) ..... B41J/2/045

OTHER PUBLICATIONS

International Search Report (foreign language).

* cited by examiner

*Primary Examiner*—John Barlow
*Assistant Examiner*—Craig A. Hallacher
(74) *Attorney, Agent, or Firm*—Sughrue, Mion, Zinn, Macpeak & Seas, PLLC

(57) ABSTRACT

While a pressure producing chamber is largely expanded before jetting ink droplets so as to increase an amount capable of capturing meniscus, distances of d1, d2, and d3 defined from the meniscus produced when the ink droplets are jetted up to a tip portion of a nozzle opening are arbitrarily varied in order to adjust the weights of the ink droplets. As a result, the ink amount of the ink droplets can be reduced which are jetted from an ink jet type recording head in which a piezoelectric vibrating element is employed as a pressure producing source.

9 Claims, 7 Drawing Sheets

INK JET RECORDING APPARATUS FOR ADJUSTING THE WEIGHT OF INK DROPLETS

TECHNICAL FIELD

The present invention relates to a recording apparatus with employment of an ink jet recording head in which a piezoelectric vibrating element is used in an actuator capable of applying pressure to a pressure producing chamber, and more specifically, to a drive technique for the ink jet type recording head.

BACKGROUND TECHNIQUE

In an ink jet type recording head, while piezoelectric materials and conductive layers are alternately stacked as a piezoelectric vibrating element, either such a piezoelectric vibrating element of a longitudinal vibration mode expanding along an axial direction thereof, or a displacement type piezoelectric vibrating element which is provided on a surface of an elastic plate and is displaced by deflection is employed. In this ink jet type recording head, a pressure producing chamber, a portion of which is constituted by an elastic plate and is communicated to a nozzle opening, is expanded/compressed by a piezoelectric vibrating element, so that ink is refilled into the pressure producing chamber and the ink of the pressure producing chamber is pressurized. As a result, ink droplets are jetted from the nozzle opening.

The piezoelectric vibrating element having the longitudinal vibration mode has high rigidity, and can be driven at high speeds. On the other hand, this piezoelectric vibrating element owns such a problem that since this piezoelectric vibrating element is required to be assembled to the elastic plate in a three-dimensional manner, complex manufacturing steps are required.

To the contrary, in the latter-mentioned ink jet type recording head with employment of the deflection displacement type piezoelectric vibrating element, either the green sheet made of the piezoelectric material can be attached, or can be directly formed on the surface of the elastic plate by way of the film forming method. As a result, the manufacturing steps thereof can be simplified. However, this recording head with using the deflection displacement type piezoelectric vibrating element would require a larger displacement area than that of the recording head with using the piezoelectric vibrating element operable in the longitudinal vibration mode. Accordingly, the volume of the pressure producing chamber is increased, and thus the ink amount of the ink droplets jetted from this recording head is also increased. This recording head owns such a difficulty. That is, it is practically difficult to form dots having very small sizes such as graphic printing operation.

To solve such a problem, it is conceivable to reduce the displacement of the deflection displacement type piezoelectric vibrating element, so that the ink amount of the jetted ink droplets maybe decreased. However, the jetting pressure is also reduced, so that the speed of the ink droplets is lowered. As a result, there are errors at the ink impinge positions on the recording medium. In particular, there is such a problem that the printing quality is apparently deteriorated in a printing operation such as graphic printing operation that precise dots are required to be formed.

The present invention has been made to solve these problems, and has an object to provide an ink jet type recording apparatus capable of forming dots suitable for a graphic printing operation by that an ink amount for constituting ink droplets is reduced as small as possible without lowering jetting speeds of the ink droplets by way of a recording head in which a piezoelectric vibrating element is employed as a drive source.

DISCLOSURE OF THE INVENTION

An ink jet type recording apparatus, according to the present invention, is featured by comprising; an ink jet type recording head including a pressure producing chamber communicated with a nozzle opening and a reservoir, for expanding/compressing the pressure producing chamber by using a piezoelectric vibrating element so as to jet an ink droplet from the nozzle opening; and drive means for outputting a drive signal to the piezoelectric vibrating element, the drive signal executing a first expansion stage for expanding the pressure producing chamber, a first compression stage for compressing the pressure producing chamber in order to jet the ink droplet from the nozzle opening, a second expansion stage for expanding the pressure producing chamber, the volume change of which is smaller than that achieved in the first expansion stage, and further a second compression stage for compressing the pressure producing chamber. The pressure producing chamber is compressed in the second compression step stage, and the pressure producing chamber is expanded in the first expansion stage, so that the meniscus produced just before the ink droplet is jetted is moved back to the pressure producing chamber side. Thereafter, the pressure producing chamber is expanded in the first expansion stage, so that a small ink amount of ink droplets can be jetted without lowering the jetting speeds of the ink droplets.

BEST MODE FOR CARRYING OUT THE INVENTION

Figure 1:
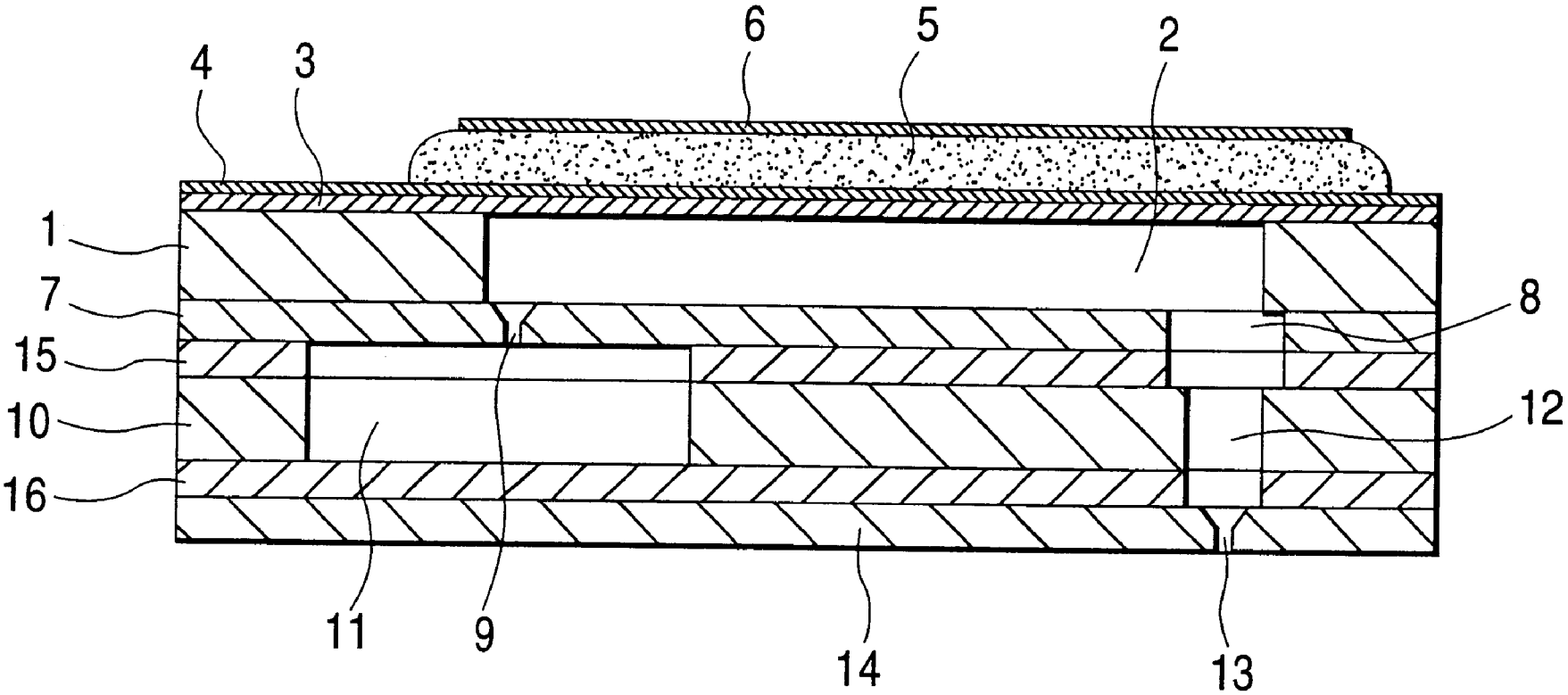
FIG. 1 is a sectional view for representing an ink jet type recording head according to an embodiment of the present invention.

A detailed description of the present invention will now be made based upon embodiments shown in the drawings.

FIG. 1 represents an ink jet type recording head according to an embodiment used in the present invention. In this drawing, symbol 1 indicates a spacer. This spacer 1 is constituted by such that a through hole for constituting a pressure producing chamber 2 is formed in a ceramics plate such as zirconium (ZrO2) having a thickness of on the order of 150 $\mu$m.

One surface of the spacer 1 is sealed by an elastic plate 3 made of a zirconium thin plate having a thickness of 10 $\mu$m, and capable of varying a volume of each of the pressure producing chambers in response to displacement of a piezoelectric vibrating element 5 (will be described later). A lower electrode 4 is formed on a surface of the elastic plate 3. The piezoelectric vibrating element 5 which is independently deflection-displaced with respect to each of the pressure producing chambers is fixed on a surface of this lower electrode 4.

This piezoelectric vibrating element 5 is manufactured by employing such a method that a green sheet made of a piezoelectric material is attached, or a piezoelectric material is sputtered. An upper electrode 6 is formed on a surface of the piezoelectric vibrating element 5, and this upper electrode 6 separately drives the piezoelectric vibrating element 5 every pressure producing chamber in order to form dots in response to printing data.

The other surface of the spacer 1 is sealed by an ink supply port forming board 7 made of a zirconium thin plate having a thickness of 150 $\mu$m The ink supply port forming board 7 is arranged by such that an ink supply port 9 is provided which connects a nozzle communication hole 8 with a reservoir 11 (will be discussed later) and the pressure producing chamber 2. The nozzle communication hole 8 is employed to connect a nozzle opening 13 of a nozzle plate 14 to a nozzle opening 13.

Reference numeral 10 indicates a reservoir forming board. In this reservoir forming board 10, the reservoir 11 and the nozzle communication holes 12 for connecting the pressure producing chamber 2 to the nozzle opening 13 are formed on a plate member having an anti-corrosion characteristic such as stainless steel having a thickness of 150 $\mu$m suitable to form an ink path.

The reservoir 11 receives ink supplied from an external ink tank, and supplies the ink to the pressure producing chamber 2. A nozzle plate 14 is employed to seal an opening surface of the reservoir forming board 10, and the nozzle openings 13 are formed on the nozzle plate 14 in the same arranging pitch as that of the pressure producing chamber 2. It should be noted that reference numerals 15 and 16 show adhesive material layers.

In the ink jet type recording head with the above-described arrangement, when drive signals are selectively applied to the piezoelectric vibrating elements 5 of the pressure producing chambers 2 communicated with the nozzle openings 13 from which the ink droplets should be jetted, the piezoelectric element 5 is discharged, so that the pressure producing chamber 2 which has been previously compressed by the intermediate potential is discharged, is returned to the balance condition. As a result, the pressure producing chamber 2 is expanded, and thus the meniscus is captured to the pressure producing chamber 2.

When the supply of the drive signal is interrupted after predetermined time has passed to charge the piezoelectric vibrating elements 5, this piezoelectric vibrating element 5 is deflection-displaced on the side of the pressure producing chamber to thereby compress the pressure producing chamber 2. During this stage, the ink in the pressure producing chamber 2 is pressurized, so that the ink droplets are jetted via the communication holes 8 and 12 from the nozzle 13.

Figure 2:
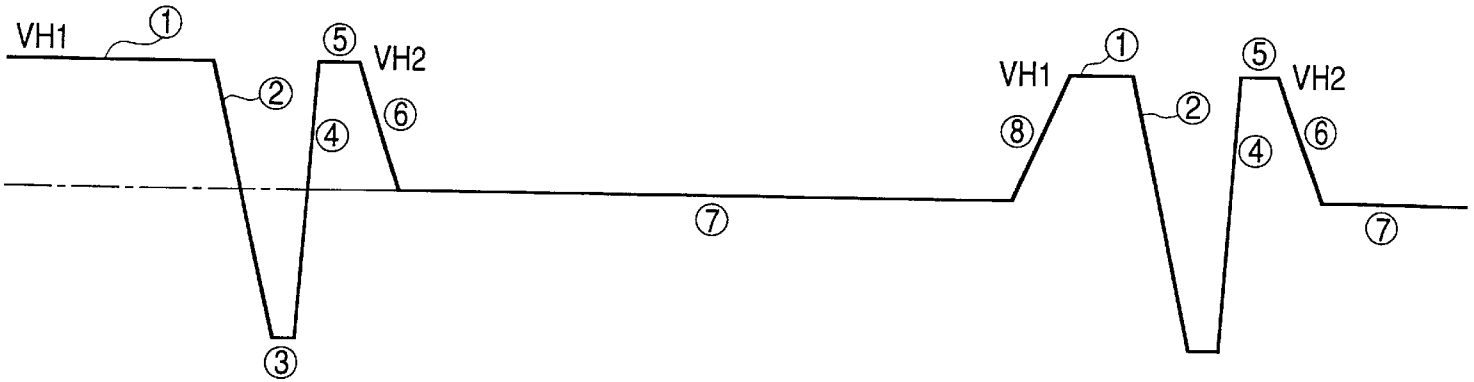
FIG. 2(A) and FIG. 2(B) are diagrams for showing a drive signal for driving the above-explained recording head, according to an embodiment, and for indicating meniscus movement by this drive signal.
Figure 2:
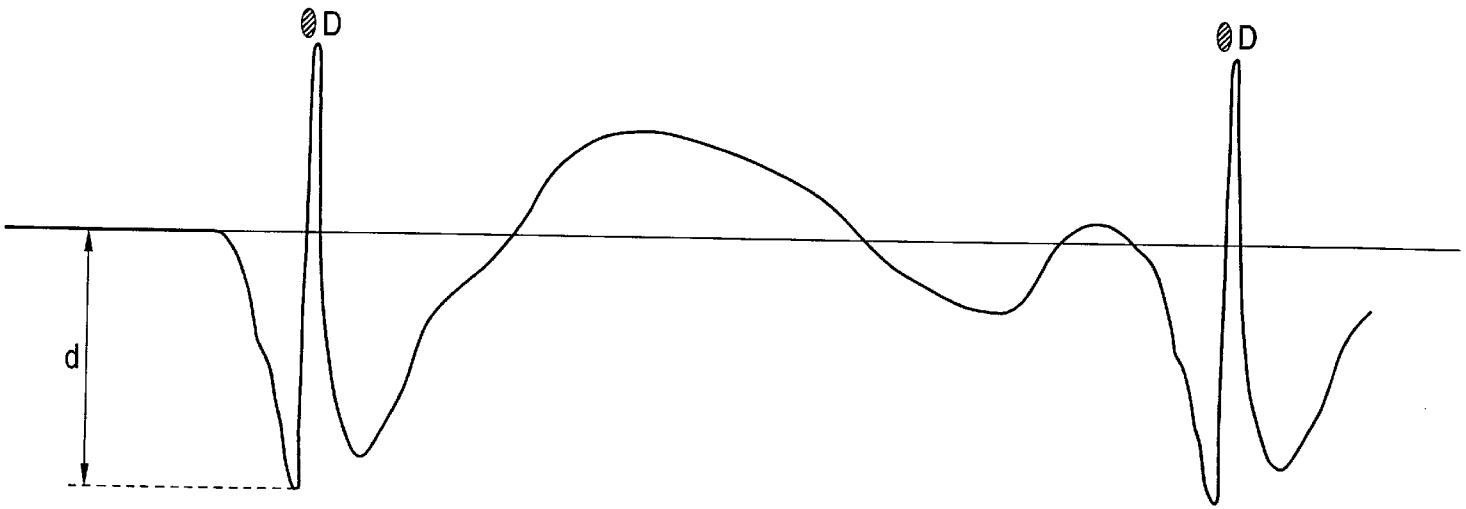

FIG. 2 represents a drive signal, according to an embodiment, suitable to jet an ink amount of ink droplets from the above-described recording head, which is smaller than the ink amount of the ink droplets normally jetted by the above-described deflection-displacement of the piezoelectric vibrating elements 5. The voltage and the gradient of the drive signal are set so as to realize a first hold stage (1); a first discharge stage (2); a second hold stage (3); a first charge stage (4); a third hold stage (5); a second discharge stage (6); a fourth hold stage (7); and a second charge stage (8). The first hold stage (1) holds such a condition that the pressure producing chamber 2 is compressed under the highest compression condition. The first discharge stage (2) captures the maximum amount of meniscus into the pressure producing chamber 2. The second hold stage (3) adjusts the jetting timing of the ink droplets. The first charge stage (4) compresses the pressure producing chamber 2 up to a second hold voltage in order to jet the ink droplets. The third hold stage (5) adjusts the attenuation timing of large vibrations of the meniscus produced after the ink droplets are jetted. The second discharge stage (6) causes the piezoelectric vibrating element 5 to be discharged up to the intermediate potential, so that an expansion amount of the pressure producing chamber 2 is made smaller than that of the pressure producing chamber 2 by the first discharge stage. The fourth hold stage (7) suppresses vibrations of the meniscus. the second charge stage (8) sets the piezoelectric vibrating element 5 to a first hold voltage without jetting the ink droplets.

Figure 3:
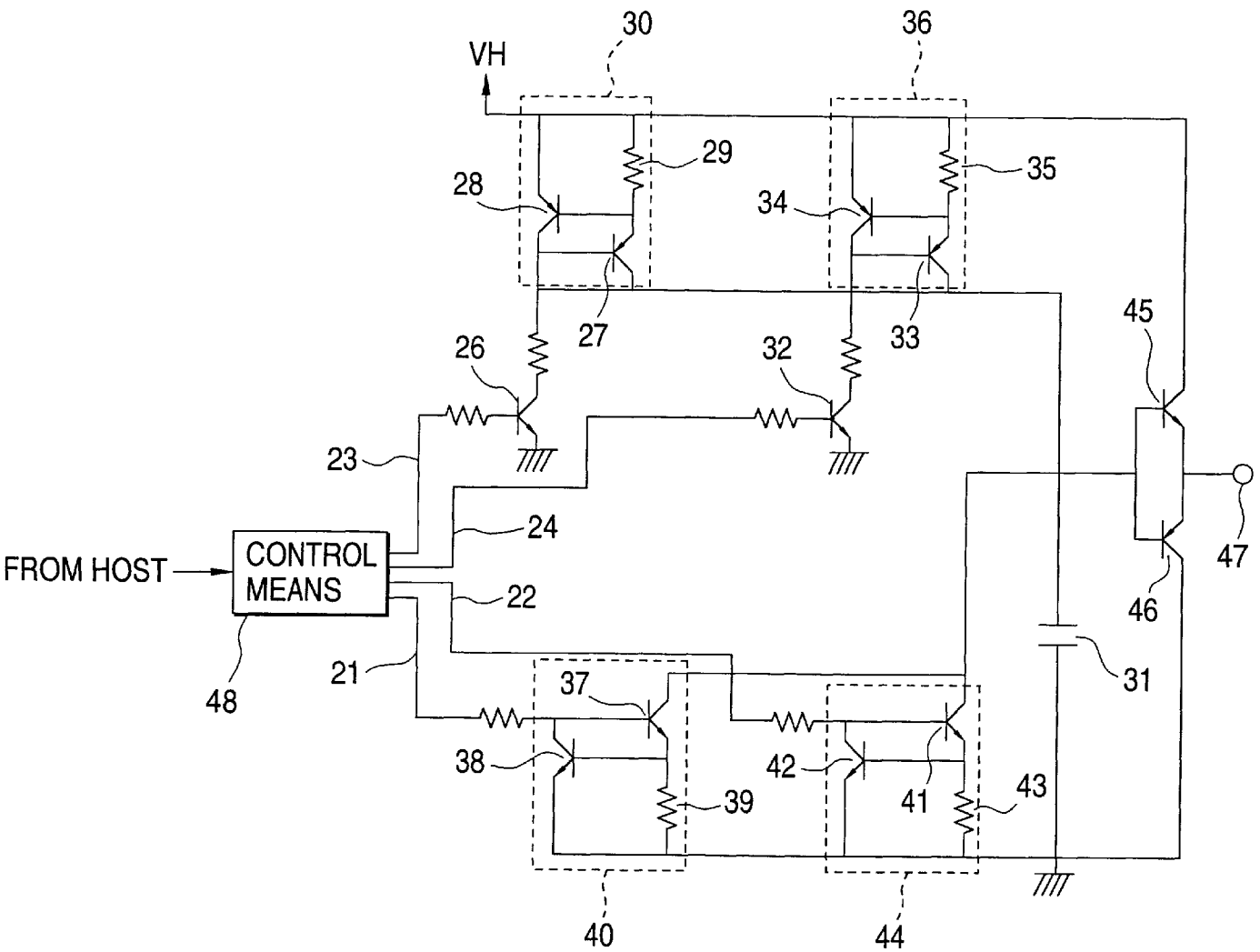
FIG. 3 is a circuit diagram for indicating a drive circuit according to an embodiment.
Figure 4:
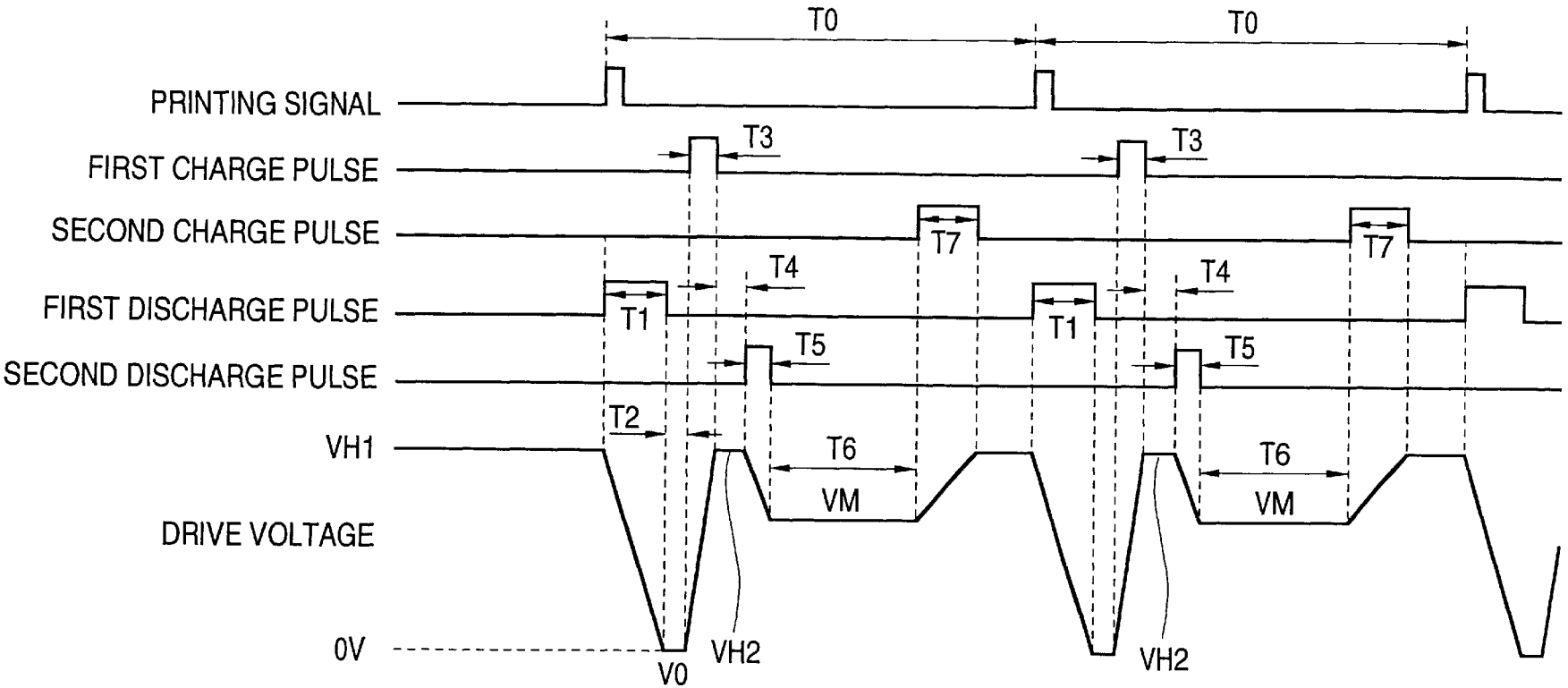
FIG. 4 is a waveform diagram for indicating timing of a signal entered into the above-explained drive circuit.

FIG. 3 shows a drive circuit for producing the above-described drive signal, according to an embodiment. In this drawing, reference numerals 21, 22, 23, and 24 show input terminals for control signals constructed of pulse signals supplied from control means 48 (will be discussed later), respectively. In response to timing of a printing signal outputted in a time period "T0" shown in FIG. 4, a first discharge pulse having a time width of "T1" for controlling the first discharge stage (2) is inputted into the input terminal 21; a second discharge pulse having a time width of "T5" for controlling the second discharge stage (6) is entered into the input terminal 22; a first charge pulse having a time width of "T3" for controlling the first charge stage (4) is inputted into the input terminal 23; and a second charge pulse having a time width of "T7" for controlling the second charge stage (8) is entered into the input terminal 24, respectively. The first charge pulse entered to the input terminal 23 is inputted into a base of an NPN type transistor 26. When the NPN type transistor 26 is conducted, a constant current circuit 30 is operated which is arranged by PNP type transistors 27 and 28, and also a resistor 29. A capacitor 31 is charged by a constant current Irb suitable for jetting ink droplets from a zero potential up to the second hold voltage. The second charge pulse entered to the input terminal 24 is inputted into a base of an NPN type transistor 32. When the NPN type transistor 32 is conducted, a constant current circuit 36 is operated which is arranged by PNP type transistors 33 and 34, and also a resistor 35. The capacitor 31 is charged by a constant current Ira from an intermediate potential VM up to the first hold voltage VH, by which the ink droplets are not jetted from the nozzle opening 13.

On the other hand, the first discharge pulse inputted into the input terminal 21 causes electron charges of the capacitor 31 to be discharged in a constant current Ifa by a constant current circuit 40 constructed of NPN type transistors 37 and 38, and also a resistor 39, so that a meniscus is largely conducted to the side of the pressure generating chamber.

Also, the second discharge pulse inputted into the input terminal 22 causes the electron charges of the capacitor 31 to be discharged in a constant current Ifb by a constant current circuit 44 constructed of NPN type transistors 41 and 42, and also a resistor 43 from the hold voltage up to the intermediate potential VM.

Assuming now that a base-to-emitter voltage of a transistor 28 is selected to be Vbe 28 and a resistance value of the resistor 29 is selected to be Rra, the charge current Ira becomes Ira=Vbe 28/Rra. Also, assuming now that the capacitance of the capacitor 31 is selected to be "C0", time "Tra" required to rise the voltage up to the first discharge voltage VH becomes Tra=C0×VH/Ira. This definition is similarly given to the constant current circuit 36. The discharge current Irb becomes Irb=Vbe 34/Rrb, and time Trb required to discharge the voltage _V becomes Trb=C0×_V/Irb.

On the other hand, as to the discharge current, assuming now that a base-to-emitter voltage of the transistor 38 in the constant current circuit 40 is selected to be Vbe 38 and a resistance value of the resistor 39 is selected to be Rfa, Ifa=Vbe 38/Rfa. Time Tfa required to drop the voltage by _V becomes Tfa=C0×_V/Ifa.

Similarly, the discharge current Ifb by the constant currant circuit 44 becomes Ifb=Vbe 42/Rfb, and falling time Tfb becomes Tfb=C0×VH/Ifb. It should also be noted that NPN type transistors indicated by reference numerals 45 and 46 shown in the drawing will constitute a current amplifier.

Next, operations of the apparatus arranged in the above-described manner will now be explained.

When a printing signal is outputted from a host, the control means 48 outputs the first discharge pulse so as to discharge the electron charges of the piezoelectric vibrating element 5. As a result, the pressure producing chamber 2 is expanded by a distance equal to a potential difference between the first hold voltage VH1 and the zero potential, so that the meniscus of the nozzle opening 13 is largely captured into the pressure producing chamber 2. When the meniscus is captured to the side of the pressure producing chamber, the movement is commenced in a self-resonant frequency. At the time when the meniscus is approached most close to the pressure producing chamber 2, the moving direction of this meniscus is inverted and then the meniscus is directed to the nozzle opening 13.

Before and after the vibration of the meniscus is inverted, the control means 48 outputs the first charge pulse so as to quickly charge the piezoelectric vibrating element 5, and the pressure producing chamber 2 is rapidly compressed by a distance equal to a potential distance between the second hold voltage VH2 and the zero potential. As a result, the ink in the pressure producing chamber 2 is pressurized, so that the meniscus is depressed from the present position to the nozzle opening side, and thus the pressurized ink is jetted as the ink droplet from the nozzle opening 13.

Since the ink amount for constituting the ink droplets is inverse proportional to the distance "d" defined from the tip portion of the meniscus to the tip portion of the nozzle opening 13, while the compression amount of the pressure producing chamber 2 is defined based upon the first hold voltage VH1, the pressure producing chamber 2 is rapidly expanded from this compression condition, so that the capture amount of the meniscus is adjusted by the above-explained compression amount. As a result, the ink amount of the ink droplets can be adjusted to be reduced.

After jetting of the ink droplets is accomplished, and the charge voltage of the piezoelectric vibrating element 5 reaches the second hold voltage VH2, such a time period has passed which is required to suppress the large vibrations of the meniscus produced after the ink droplets have been jetted. At this time instant, the control circuit 48 outputs the second discharge pulse so as to decrease the voltage of the piezoelectric vibrating element 5 to the intermediate potential VM.

Also, the ink of the reservoir 11 will flow from the ink supply port 9 into the pressure producing chamber 2, so that the amount of ink which is equal to the amount of consumed ink by jetting the ink droplets is refilled into the pressure producing chamber 2, and the meniscus is projected from the nozzle opening in such a degree that the ink droplets are not jetted in combination with this ink refill operation.

After the vibrations of the meniscus are suppressed in the above-described manner, the control means 48 outputs the second charge pulse in order to charge the piezoelectric vibrating element 5 from the intermediate potential VM to the first hold voltage VH1.

As previously described, the control means 48 outputs the second charge signal so as to compress the pressure producing chamber 2 under such a condition that the vibrations of the meniscus after the ink droplets have been jetted are suppressed, namely after the remaining vibrations of the meniscus are inverted on the side of the nozzle opening at second time. Therefore, the voltage of the piezoelectric vibrating element 5 is increased from the intermediate potential VM to the first hold voltage VH1, and the meniscus can be suppressed at the position suitable for jetting the ink droplets without jetting the ink droplets from the nozzle opening 13.

To the contrary, when the control means outputs the second discharge pulse under such a condition that the meniscus is projected from the nozzle opening 13, the meniscus is pushed out. As a result, there are inconvenient conditions that the jetting routes of the ink droplets are induced while the nozzle plate 14 is wetted by the ink, and the ink mist is induced.

As previously explained, after the piezoelectric vibrating element 5 has been charged up to the first hold voltage V41, the above-described steps (2) to (8) are performed, so that a small amount of the ink droplets can be jetted.

Figure 5:
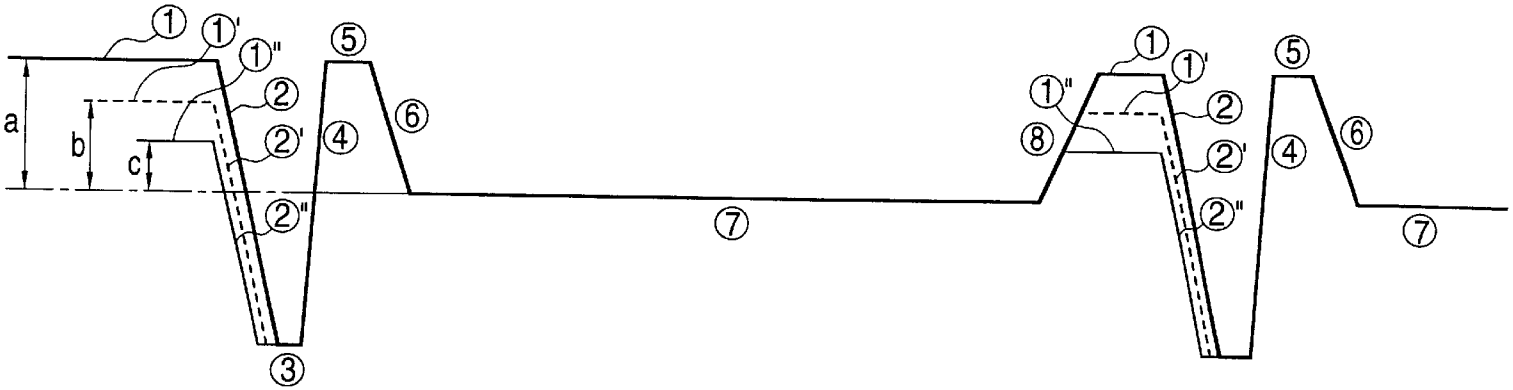
FIG. 5(A) and FIG. 5(B) are diagrams for representing a drive signal used to adjust a first hold voltage by way of time, and meniscus movement corresponding to this drive signal.
Figure 5:
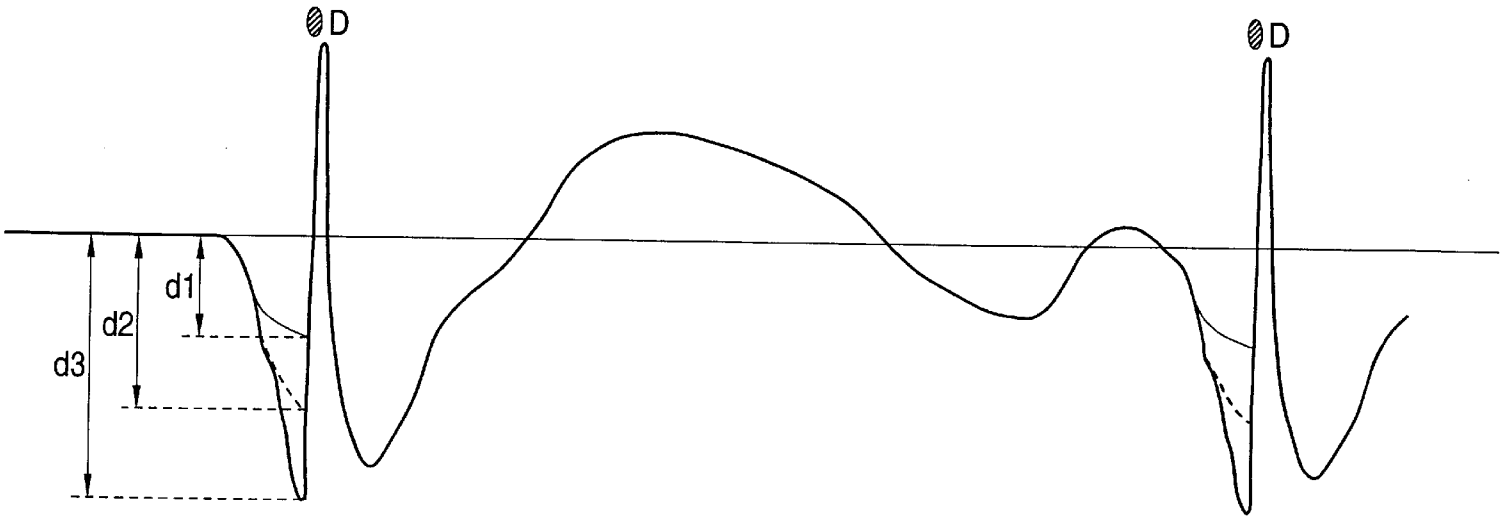

As previously explained, the amount of ink which constitutes the ink droplets is varied, depending upon the distances "d1", "d2", and "d3" defined between the tip portion of the meniscus and the nozzle opening 13 at the time instant when the pressure producing chamber 2 starts to be rapidly compressed. Moreover, the distances "d1", "d2", and "d3" are influenced by the potential differences (symbols a, b, c shown in FIG. 5) between the first hold voltage VH1 and the intermediate potential VM in the second charge step (8). As a consequence, the ink amounts of the ink droplets, namely the sizes of dots formed on the printing medium can be adjusted based upon the first hold voltage VH1. As a result, the sizes of the dots formed on the printing medium can be adjusted based on the time width T7 of the second charge pulse.

Figure 6:
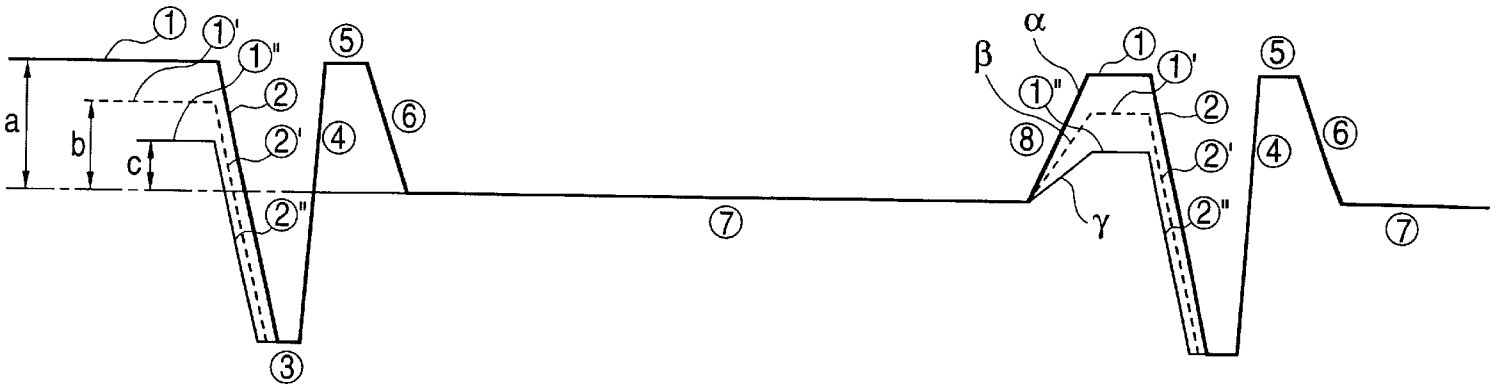
FIG. 6(A) and FIG. 6(B) are diagrams for representing a drive signal used to adjust a first hold voltage by way of a voltage gradient, and meniscus movement corresponding to this drive signal.
Figure 6:
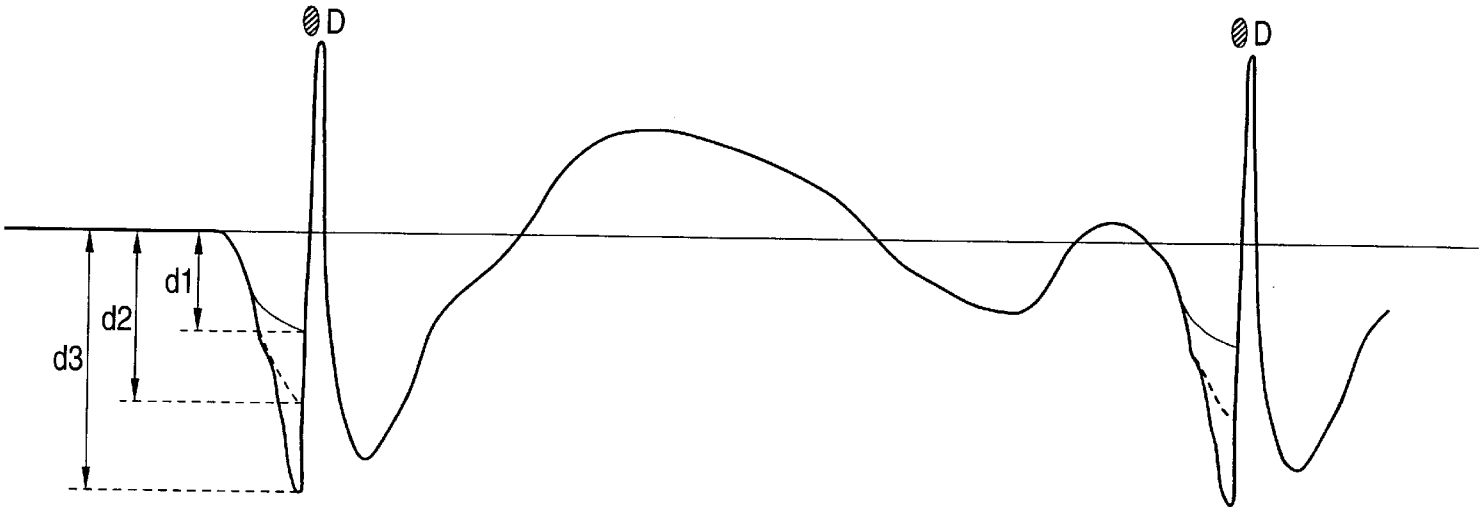

Also, as indicated in FIG. 6, even when the first hold voltage VH1 is adjusted by the gradations "α", "β", and "γ" of the voltages in the second charge stage (8), which are applied after the second hold stage (7) for suppressing the meniscus, the potential differences in the second charge stage (2) are similarly varied. As a consequence, the distances "d1", "d2", and "d3" defined between the tip portion of the meniscus and the nozzle opening 13 are varied, so that the sizes of the dots formed on the printing medium can be adjusted.

Figure 7:
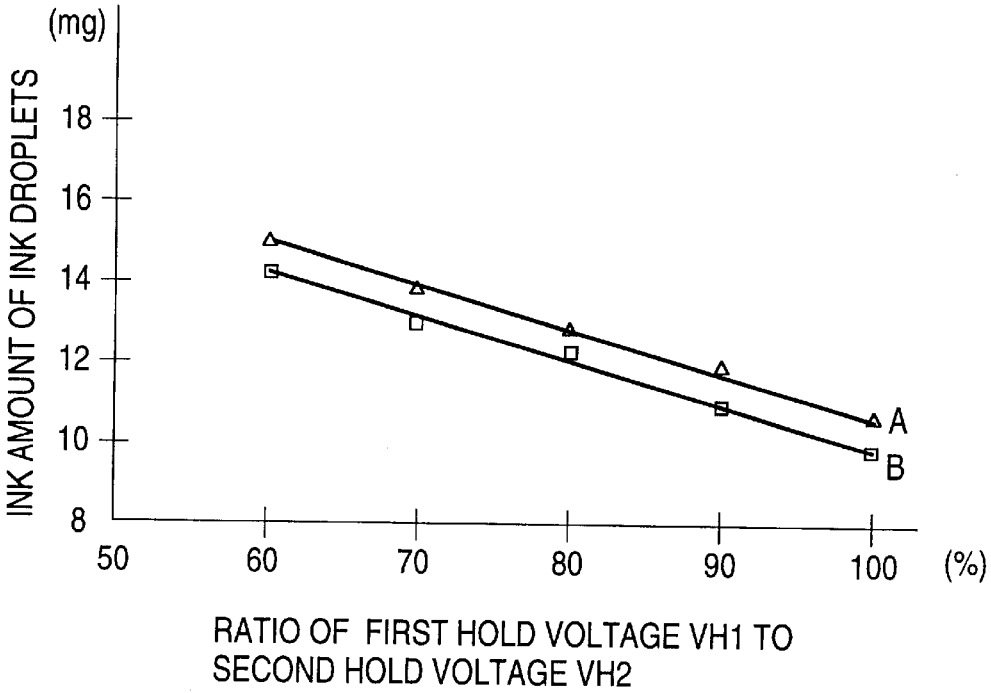
FIG. 7 is a diagram for showing a relationship between a ratio of the first hold voltage VH to a second hold voltage, and an ink weight of ink droplets.

As represented in FIG. 7 the larger the ratio of the first hold voltage VH1 to a maximum potential, namely the second hold voltage VH2 is increased, the larger the capture amount of the meniscus into the pressure producing chamber 2 is increased. Moreover, this ratio can maintain a substantially linear relationship with respect to the ink amount of the ink droplets.

Then, another relationship of the ink amount of the ink droplets with respect to the ratio of the first hold voltage VH1 to the second hold voltage VH2 may be maintained even when the piezoelectric vibrating element is driven at a drive frequency of 7.2 kHz (symbol "A" in FIG. 7), and also at another drive frequency of 3.6 kHz (symbol "B" shown in FIG. 7).

Accordingly, the ink amounts of the ink droplets can be adjusted irrespective of the drive frequencies while maintaining the reduction ratio in such a manner that the pulse width T7 of the second charge pulse, or the voltage gradation in the second charge stage are adjusted to control the first hold voltage VH1.

It should be understood that the above-described embodiment has described such a case that the ink amounts of the ink droplets are positively adjusted. Alternatively, the ink amounts of the ink droplets caused by a variation in a viscosity coefficient of ink due to temperatures may be kept constant by adjusting the pulse width T7 of the second charge pulse, or the voltage gradient in the second charge stage with reference to the temperatures.

Figure 8:
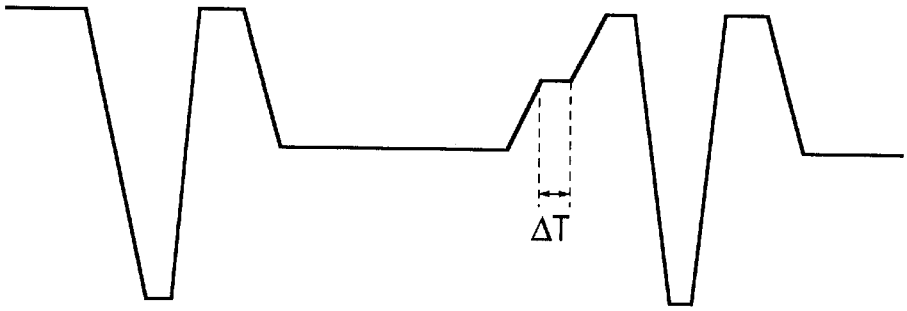
FIG. 8(A) and FIG. 8(B) are waveform diagrams for showing signals used to control the first hold voltage, respectively.
Figure 8:
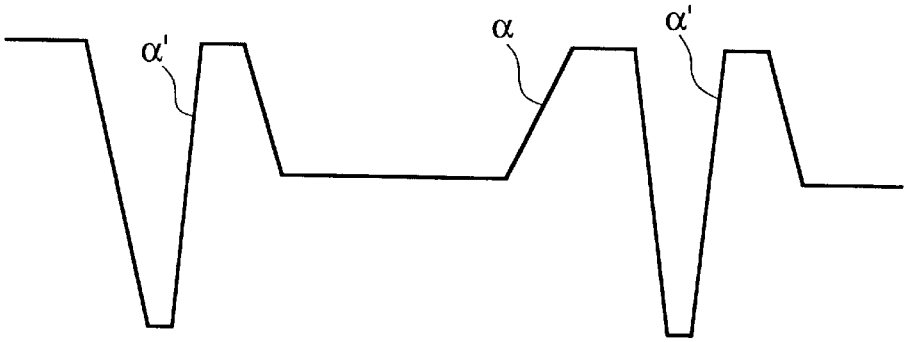

Also, in the above described embodiment, the piezoelectric vibrating element is continuously charged from the intermediate potential to the first hold voltage VH1. Alternatively, as indicated in FIG. 8(A), a delay having a constant time "ΔT" is set between the mutual waveforms, and the potential is increased while subdividing the second stage into two sub-stages (2)' and (2)". Otherwise, the voltage gradient is set to such a low voltage gradient "α" than the voltage gradient "α'" when the ink droplets are jetted. Accordingly, the piezoelectric vibrating element 5 may be charged up to the first hold voltage VH1 without largely moving the meniscus in the useless manner.

Although the above-explained embodiment has described such a case that the frequency variation occurs in the first hold step (1), a similar effect may be achieved even when the frequency variation occurs in the fourth hold stage (7).

INDUSTRIAL USABILITY

As previously described in detail, in accordance with the present invention, after the pressure producing chamber has been compressed in the second compression stage, the pressure producing chamber is expanded in the first expansion stage so as to secure the large expansion amount of the pressure producing chamber. In addition, since the distance is increased by which the meniscus can be captured before the ink droplets are jetted, the ink amounts of the ink droplets can be adjusted over a wide range without inducing the large variations in the speeds of the ink droplets. As a result, not only a small ink amount of ink droplets suitable for the graphic printing operation can be jetted, but also the ink amounts of the ink droplets which are suitable for various print modes can be jetted. Conversely, while the ink amount is controlled to be a constant value, which is easily varied by a change in the external environments, the printing quality can be maintained.

What is claimed is:

1. An ink jet type recording apparatus comprising:

an ink jet type recording head including a pressure producing chamber communicated with a nozzle opening and a reservoir, and a piezoelectric vibrating element for expanding/compressing said pressure producing chamber so as to jet an ink droplet from said nozzle opening; and drive means for outputting a drive signal to said piezoelectric vibrating element, said drive signal executing a first expansion stage for expanding said pressure producing chamber, a first compression stage for compressing said pressure producing chamber in order to jet the ink droplet from the nozzle opening, a second expansion stage for expanding said pressure producing chamber, the volume change of which is smaller than that achieved in said first expansion stage, and further a second compression stage for compressing said pressure producing chamber, wherein an amount of the jetted ink droplets is adjusted by an expanded volume by the first expansion stage controlled by a duration period of the second compression stage.

2. An ink jet type recording apparatus as claimed in claim 1 wherein:

said second compression stage is present after at a time instant when remaining vibrations of meniscus caused by jetting the ink droplet just before this time instant are inverted to the nozzle opening side at a second time.

3. An ink jet type recording apparatus as claimed in claim 1, wherein:

a plurality of printing modes are realized by a volume change amount in said first compression stage.

4. An ink jet type recording apparatus as claimed in claim 2, wherein:

said plurality of printing modes are realized by a time duration of said second compression stage.

5. An ink jet type recording apparatus as claimed in claim 3 wherein:

said plurality of printing modes are realized by varying a compression speed of said second compression stage.

6. An ink jet type recording apparatus as claimed in claim 4 wherein:

said duration time of said second compression stage is changed in response to a temperature.

7. An ink jet type recording apparatus as claimed in claim 5 wherein:

a compression speed of said second compression stage is changed in response to a temperature.

8. An ink jet type recording apparatus as claimed in claim 1 wherein:

said second compression stage is subdivided into a plurality of stages.

9. An ink jet type recording apparatus as claimed in claim 1 wherein:

a compression speed of said second compression stage is set to be lower than that of said first compression stage.

* * * * *